US008562451B2

(12) United States Patent
Crabtree

(10) Patent No.: US 8,562,451 B2
(45) Date of Patent: Oct. 22, 2013

(54) GOLF SWING TRAINER

(76) Inventor: William E. Crabtree, Evansville, IN (US)

( * ) Notice: Subject to any disclaimer, the term of this patent is extended or adjusted under 35 U.S.C. 154(b) by 73 days.

(21) Appl. No.: 12/932,419

(22) Filed: Feb. 24, 2011

(65) Prior Publication Data

US 2011/0306434 A1 Dec. 15, 2011

Related U.S. Application Data

(60) Provisional application No. 61/338,820, filed on Feb. 24, 2010.

(51) Int. Cl.
*A63B 69/36* (2006.01)

(52) U.S. Cl.
USPC ..... 473/215; 473/277

(58) Field of Classification Search
USPC ..... 473/215, 266, 277, 409; D21/791
See application file for complete search history.

(56) References Cited

U.S. PATENT DOCUMENTS

| | | | | | |
|---|---|---|---|---|---|
| 1,669,457 | A | * | 5/1928 | Dailey | 473/215 |
| 4,688,800 | A | | 8/1987 | Lopez | |
| 5,441,271 | A | * | 8/1995 | Briggs | 473/215 |
| 5,643,097 | A | | 7/1997 | Bechler et al. | |
| 5,785,603 | A | | 7/1998 | Lazier | |
| 404,103 | A | | 1/1999 | Winters | |
| D404,103 | S | * | 1/1999 | Winters | D21/791 |
| 5,879,240 | A | * | 3/1999 | Stuart | 473/215 |
| 5,984,796 | A | | 11/1999 | Mah | |
| 6,332,845 | B1 | | 12/2001 | Priestley | |
| 6,458,036 | B1 | | 10/2002 | Gutierrez | |
| 6,503,148 | B2 | * | 1/2003 | Lane | 473/215 |
| 7,066,825 | B1 | * | 6/2006 | Moussa | 473/215 |
| D654,131 | S | * | 2/2012 | Crabtree | D21/791 |
| 2002/0173368 | A1 | * | 11/2002 | Lane | 473/215 |
| 2006/0154737 | A1 | * | 7/2006 | Moussa | 473/215 |
| 2007/0173338 | A1 | | 7/2007 | Williams | |
| 2008/0176665 | A1 | | 7/2008 | Snyders | |
| 2011/0201438 | A1 | * | 8/2011 | Butts et al. | 473/215 |
| 2011/0306434 | A1 | * | 12/2011 | Crabtree | 473/215 |

* cited by examiner

*Primary Examiner* — Raleigh W Chiu
(74) *Attorney, Agent, or Firm* — Carrithers Law Office PLLC

(57) ABSTRACT

A golf swing trainer which gives a golfer immediate feedback as to whether the relative timing of the hip movement to the club movement is correct. The trainer comprises a light-weight swing arm which is pivotally connected to the user's belt. For a right handed user, the swing arm on the trainer is initially placed to the right of a right-handed user and is pushed around by the movement of the user's left forearm during a correct golf swing. On the other hand, if the golfer's arms pass in front of the swing arm without swinging it around with the arms, the timing of hip movement was incorrect. In the case of a left handed golfer, the trainer swing arm is initially moved to its far left position and, as before, during the downswing, the user's arms should come in behind and push the trainer swing arm around ahead of the user's arm.

17 Claims, 10 Drawing Sheets

GOLF SWING TRAINER

CROSS REFERENCE TO RELATED APPLICATIONS

This application claims priority to provisional application Ser. No. 61/338,820 filed on Feb. 24, 2010.

TECHNICAL FIELD

The present invention relates to the field of devices used by a golfer to develop a proper swing.

DESCRIPTION OF THE RELATED ART

U.S. Patent Application Publication No. 2006/0154737 A1 by Moussa for GOLF SWING TRAINING AID AND METHOD OF USE OF THE SAME published on Jul. 13, 2006 teaches a flexible pointer secured to the user's belt between the 'hip bone and the belly button' whereupon the a right handed user's right forearm is intended to contact the tip of the pointer during a proper downswing. Conversely, a left-handed user wears the pointer to the left of the belly button and intends to strike the tip of the pointer with the right forearm during a downswing.

U.S. Pat. No. 5,643,097 by Bechler et al. for HIP ROTATION TRAINING DEVICE issued on Jul. 1, 1997 teaches a pointer attached to a user's belt near the left hip of a right handed user wherein the pointer gives an indication of correct hip rotation and no contact with the end of the pointer is expected or desired. On the other hand, a left-handed user wears the pointer on the right side and uses it in a similar manner to above.

U.S. Pat. No. 6,503,148 B2 by Lane for GOLF SWING TRAINING DEVICE AND METHOD issued on Jan. 7, 2003 teaches a rod pivotally mounted on the center of a belt worn by the user. The rod has a hook near its end which receives and holds the golf club near its head. The rod acts as a guide for the golf club as the user swings it.

U.S. Pat. No. 4,688,800 by Lopez for GOLF SWING GUIDE issued on Aug. 25, 1987 teaches a triangular shaped guide fixed to a belt worn around the golfer's waist with the forward facing edge of the triangle approximately collinear with a line drawn tangent to the front of the golfer's belly. The guide has no moving parts. During the back swing and downswing, the golfer's forearms should not contact the guide but should pass nearby it for good form.

BACKGROUND OF THE INVENTION

Moussa's GOLF SWING TRAINING AID AND METHOD OF USE OF THE SAME provides a target which a user's trailing forearm (e.g., the right arm of a right handed golfer) is intended to contact during the downswing. Directly after that contact, the pointer springs back to its normal position. The idea of aiming to 'hit' a springy pointer with one's forearm would appear to be a psychological detriment to a user and to not give a comfortable 'feel' to a user. Further, the sensation of the pointer springing back into position would be a mental detriment as well. Bechler's HIP ROTATION TRAINING DEVICE simply extends out from the downstream side of a user's belt and provides a sort of visual feedback of proper hip rotation but does not give any concrete knowledge of having used the proper hip rotation. It must be viewed 'out of the corner' of the user's eye, which would certainly be awkward and not easy to use. Lane's GOLF SWING TRAINING DEVICE AND METHOD appears to be, at best, cumbersome to use and even awkward and restricting. It restricts one end of the golf club and restricts any freedom of movement of the user's arms and hands, and therefore cannot provide any natural feel of club movement. During the use of Lopez' GOLF SWING GUIDE, the golfer must either watch for or feel the guide during the stroke to use it properly. Applicant's invention requires no watching or 'feeling' of a motionless guide. If the swing arm isn't pushed around during the golf swing, the swing was incorrect. The golfer has only to check that the trainer swing arm moved from one side to the other.

A proper golf swing is dependent upon the proper timing between hip movement and the downswing. The downswing is initiated by the hips turning toward the target after which the arms pull the club down to strike the ball. Thus, a proper golf swing requires that the golfer uncoils, starting at their feet and extending upward through the body to the head of the club. What is needed is a device which gives a golfer immediate feedback throughout the swing and follow through to indicate correct coordination and timing.

SUMMARY OF THE INVENTION

The present invention provides a golf swing trainer comprising a base member rigidly secured to a belt member sized to be securely fastened around a user's waist, said base member having a pivot pin and a swing arm, said swing arm being pivotally mounted to said base member by said pivot pin and being capable of swinging horizontally in an arc of approximately 180 degrees.

Applicant's GOLF SWING TRAINER provides a lightweight swing arm which swings in a plane which is approximately perpendicular to the user's spinal column from an upstream position to a downstream position during a golfer's swing. The trainer swing arm pivots on a pin secured in a base which is clipped onto the user's belt. It cannot swing loosely because a slight amount of friction tends to hold it in place, but it can be pushed easily.

Before addressing the ball, a right handed golfer swings the trainer swing arm all the way to the right side where it is stays in that position. Therefore, the swing arm is behind and to the right of the user's right arm when addressing the ball. The arm is still in this position at the top of the user's back swing. As the user begins the downstroke, the user's waist should turn toward the left before the golf club and arms are halfway down. This moves the swing arm to the left far enough that as the user's left arm comes down, it comes behind and pushes the swing arm on around to the left during the stroke of the club. This ensures that the critical timing between the hip movement and the arm movement is proper and that full power can be transferred squarely to the ball. If the user's arm's come down in front of the swing arm such that it remains on the right side of the user, then the proper timing did not exist and the user immediately knows this.

It is an object of this invention to provide a golf swing trainer which provides immediate feedback to the user about the relative timing between the hip movement and the arm movement during a golf swing, which is critical for a proper swing.

It is an object of this invention to provide a golf swing trainer which is easy to set up and to use.

It is an object of this invention to provide a golf swing trainer which is lightweight and unrestrictive to use.

BRIEF DESCRIPTION OF THE DRAWINGS

A better understanding of the present invention will be had upon reference to the following description in conjunction with the accompanying drawings in which like numerals refer to like parts throughout the views wherein:

FIG. 18 shows a perspective view of the golf swing trainer wherein a golfer is following though on their swing contacting the swing arm and pushing the swing arm forward at the point of contact and address of the ball through the follow through.

DESCRIPTION OF THE PREFERRED EMBODIMENTS

In accordance with the present invention, there is provided a golf swing trainer which gives a golfer immediate feedback as to whether the relative timing of the hip movement to the club movement is correct.

Figure 2:
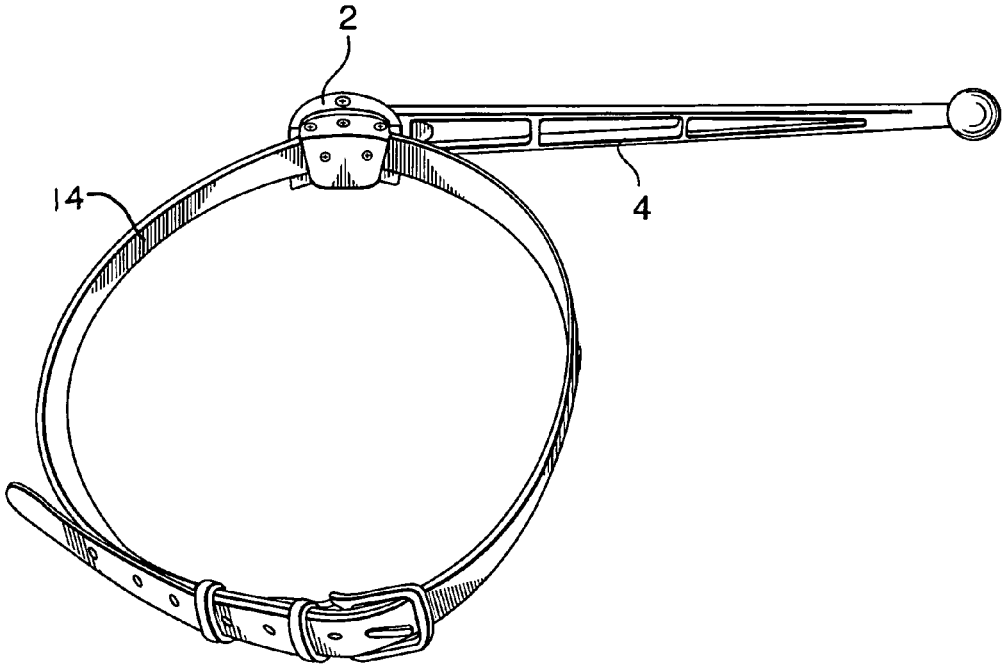
FIG. 2 shows the swing arm and base of the embodiment of FIG. 1 permanently fastened to a belt.

As shown in FIG. 2 shows the golf swing trainer 10 includes base member 2 rigidly secured to belt member 14 with holding means such as screws, rivets, stitches or the like 12.

Figure 1:
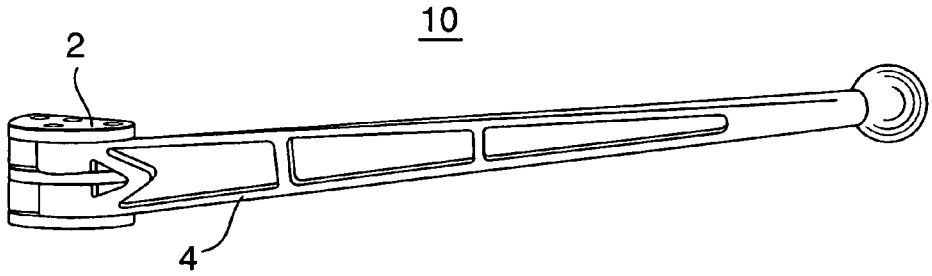
FIG. 1 is a front view of an embodiment of the trainer swing arm.
Figure 16:
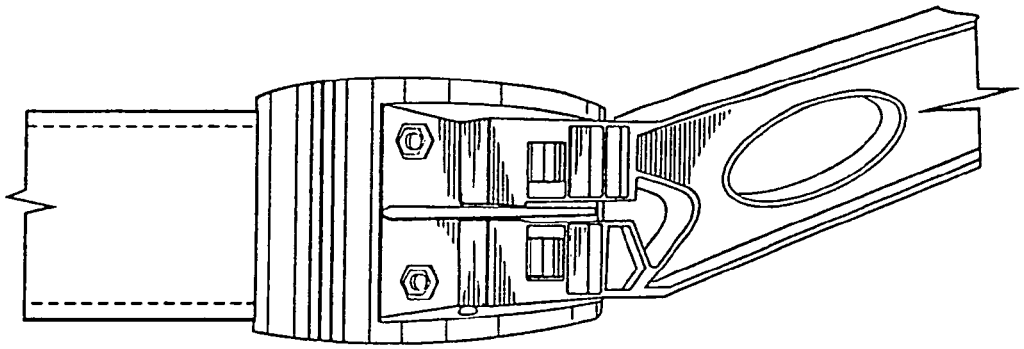
FIG. 16 shows a perspective view of the golf swing trainer base member and belt of the embodiment of FIG. 13.
Figure 17:
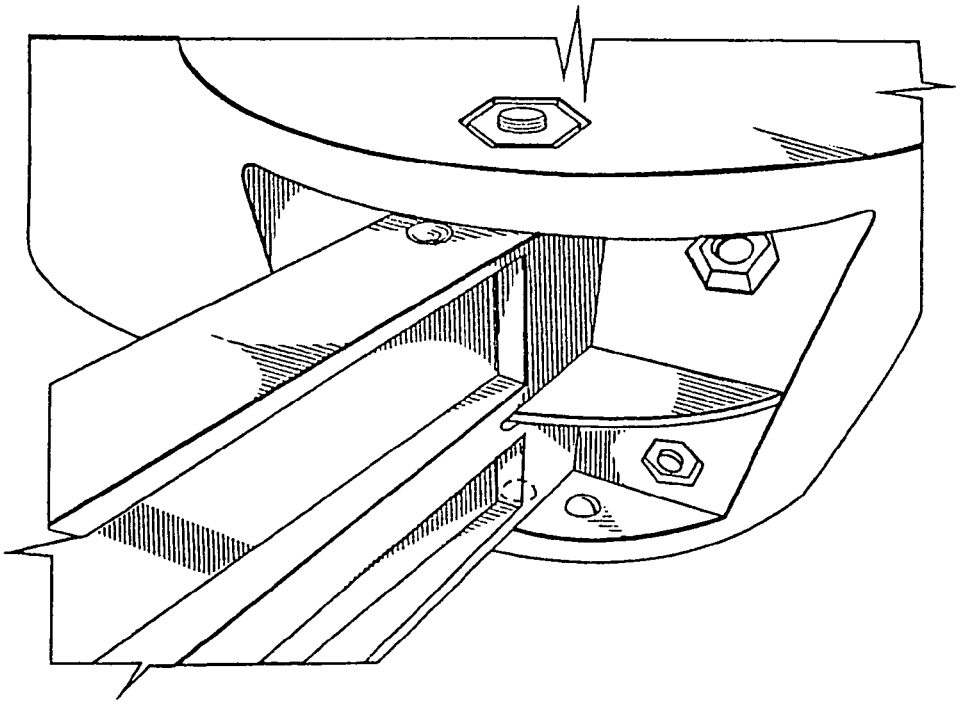
FIG. 17 shows a perspective view of the golf swing trainer base member of the embodiment of FIG. 13 wherein the positioning means comprising a spring loaded ball disposed in the upper and lower surface of the swing arm for cooperative engagement with recess formed in the top and bottom surface of the channel of the base member.
Figure 18:
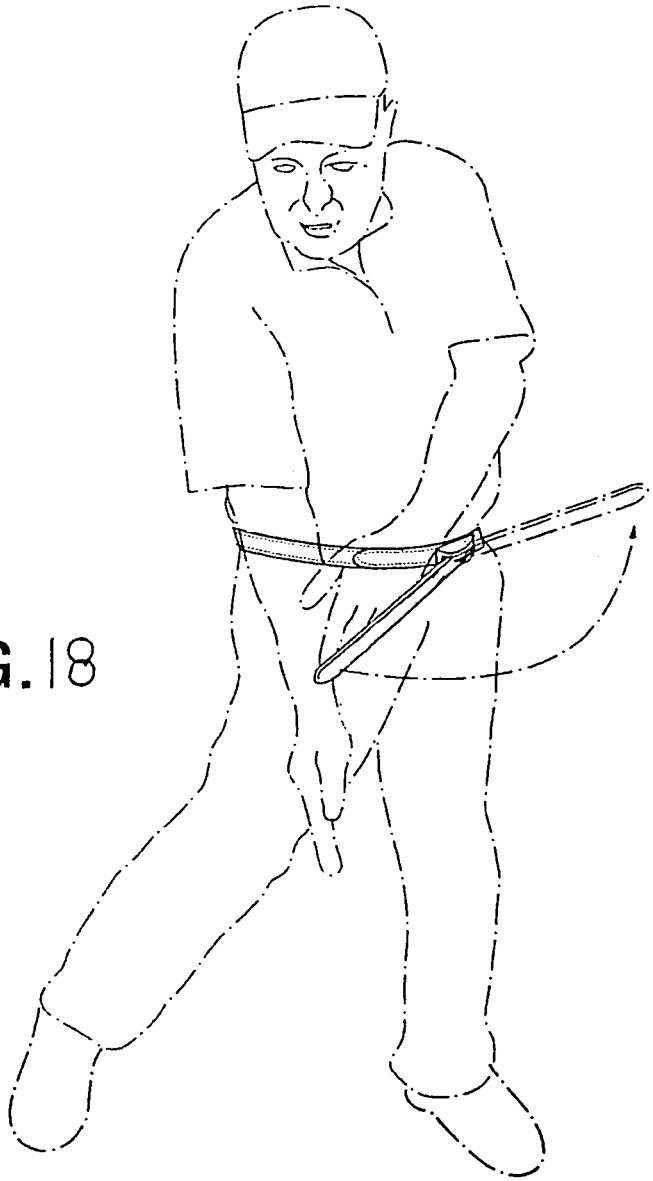

FIGS. 1, 16 and 17 show the base member comprising a integral block or plate of metal, plastic, fiberglass or other material. In one preferred embodiment the base member 2 is molded as an integral block of plastic material having webbing across the rear surface to decrease weight and increase strength. The front portion of the base plate 2 includes a pair of spaced apart wide flat channels 30 formed horizontally across the base plate 2 wherein a longitudinal flange 32 is formed between the channels extending front end to end of the channels 30 forming a guide member and support means for the swing arm which is pivotally connected to the center of the base member wherein the base of the swing arm includes a central slot or slit 34 which cooperatively enagages the flange 32 of the base member 2. Swing arm positioning means comprises an upper and lower recesses or indentions 20 are formed at selected points along the top 26 of the upper channel and bottom 28 of the lower channel to cooperatively engage spring loaded projection balls or other compressible projecting means 22 extending from the top and bottom surfaces of the swing arm at its base. The swing arms then are positioned in a break-away fashion at the correct angle for a golfer to swing and contact the swing arms at the desired rotation of the body and swing of the club to indicate the proper follow through.

As shown in the drawings, the trainer swing arm 4 pivots on pivot pin 6 and is canted at an angle $\alpha$ above a plane which is perpendicular to pin 6, in order to place the arm in position to be moved by a user's forearm. Angle $\alpha$ may be up to 20 degrees and more preferably 10 to 15 degrees. Of course, the swing arm is still usable when it is at a level position with respect to the ground at an angle of 0; however, the effectiveness is restricted slightly. Pin 6 can be a screw or bolt which can be tightened or loosened to adjust the force required to swing arm 4 around on pin 6. Swing arm 4 can swing approximately 180 degrees on its base 2 and is lightly held in place by friction due to the tightened pivot screw 6. A user can adjust screw pin 6 to provide any preferred stiffness for swing arm 4.

Base 2 is mounted onto belt 14 so that when the belt is worn, the belt buckle will be positioned so as not to bother the user. When wearing the belt, base 2 is preferably placed to the left of the center of the user's waist for a right handed golfer. Preferably, base 2 is placed four to six inches to the left of the center of the user's waist for a right handed golfer. Swing arm 4 must be long enough so that, during use, the golfer's leading forearm and hands cannot reach past the free end of it to prevent the golfer's hands or arms from snagging or catching end 7 of arm 4 during a poor swing. Swing arm 4 contains a rounded or spherical enlargement 7 which is smooth and helps to prevent snagging during use or handling.

Figure 4:
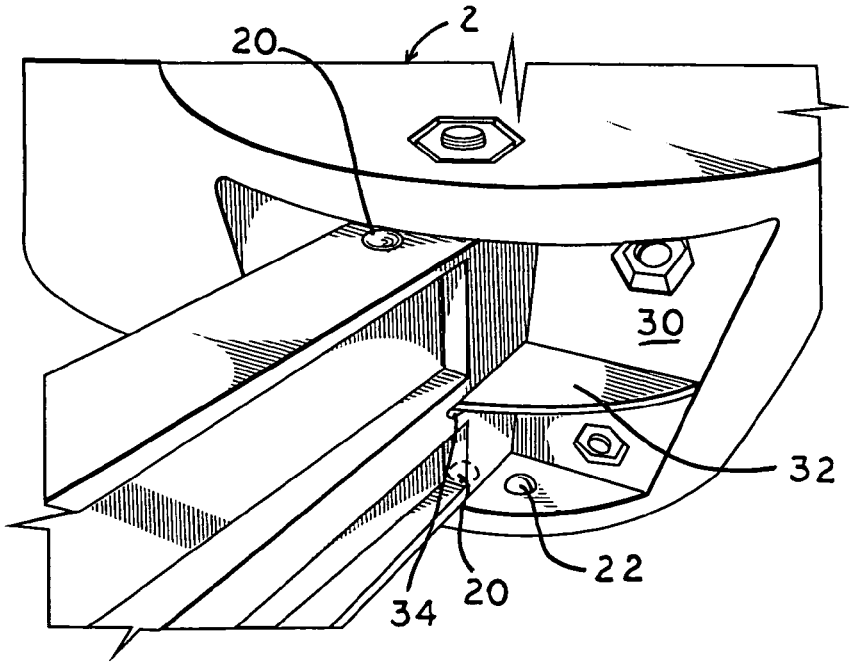
FIG. 4 shows a user wearing the golf swing trainer of FIG. 1 addressing the ball.
Figure 5:
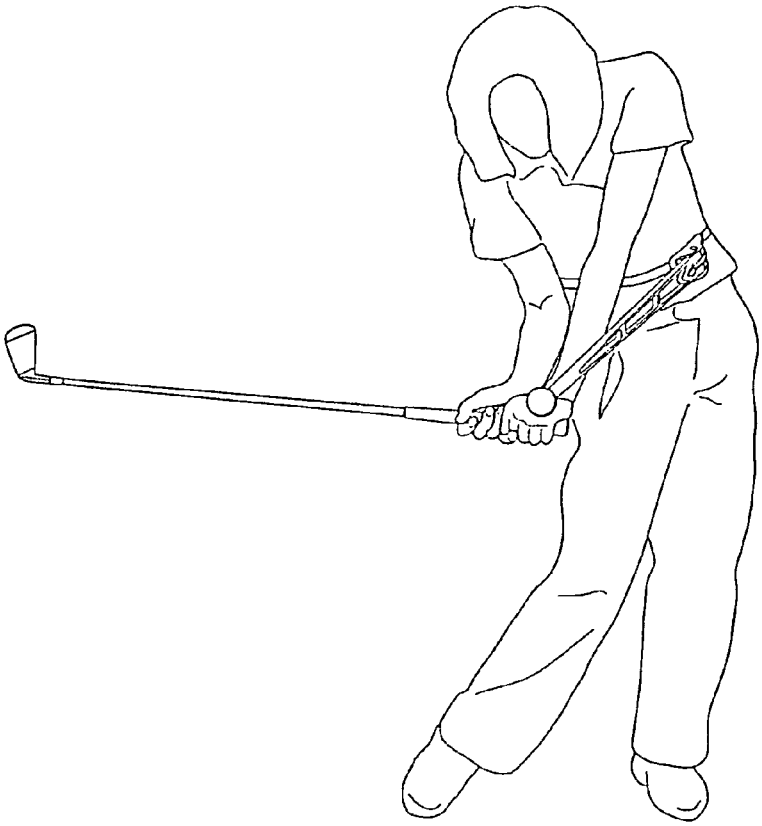
FIG. 5 shows a user wearing the embodiment of FIG. 1 in the up swing with the hands and arms rising upward to past the swing arm and with the hips and waist rotated accordingly.

To prepare to use golf swing trainer 10, a right-handed user should swing the swing arm 4 all the way to its right most position within base 2 as shown in FIG. 4. On the up swing, the user's waist should twist to the left before the arms come down, as shown in FIG. 5. In the down swing, the left forearm follows the swing arm 4 through the rotation of the hips and uncoiling of the body shown best in FIG. 6 and around to the left side during the follow-through as shown in FIG. 7. The instructions are the same for a left-handed golfer except for interchanging the words 'left' and 'right'.

Figure 6:
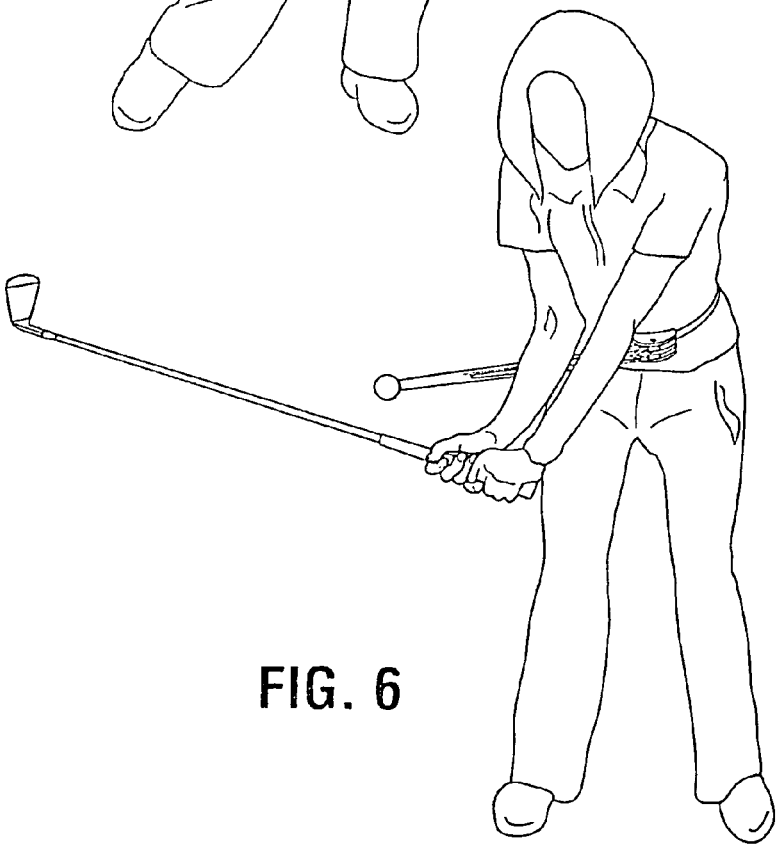
FIG. 6 shows a user wearing the embodiment of FIG. 1 in the down swing with the arms behind and following the swing arm and with the hips and waist twisting or unwinding accordingly at the proper time whereby the user's arm comes in behind and contacts the swing arm.
Figure 7:
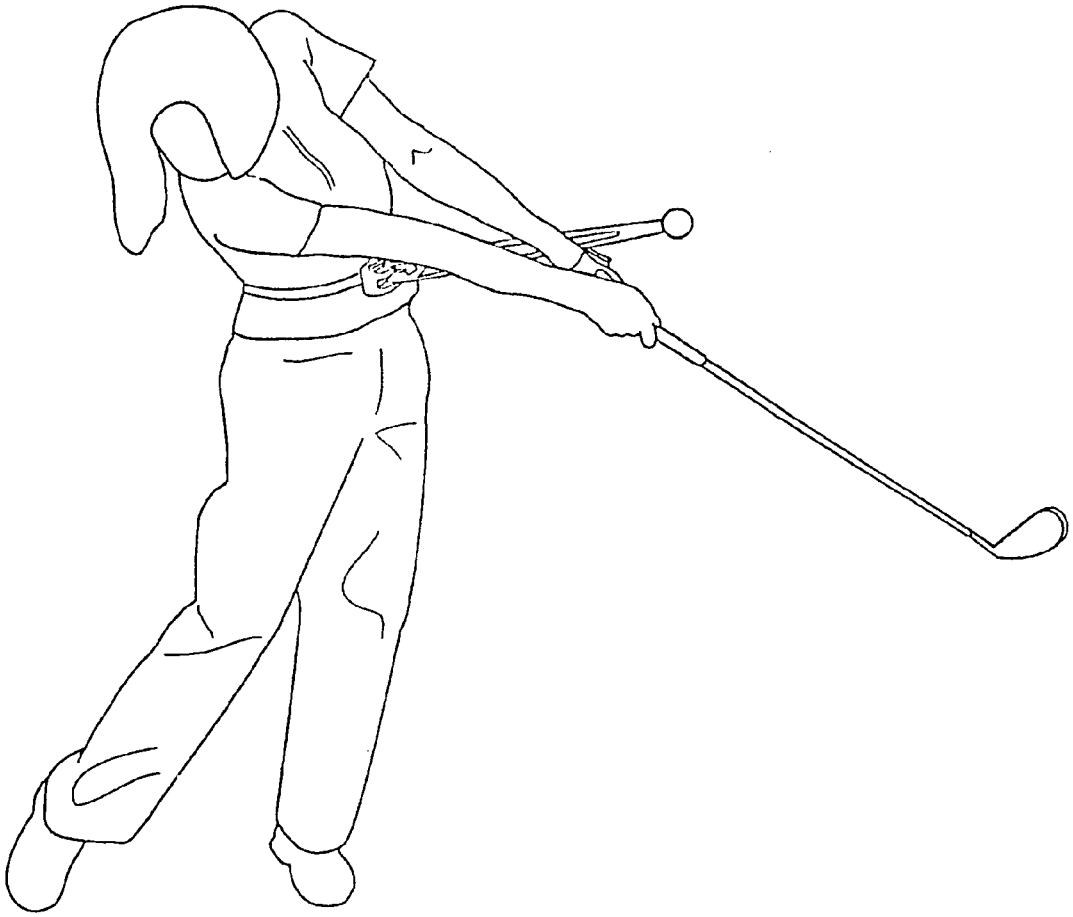
FIG. 7 shows the user wearing the embodiment of FIG. 1 with the proper follow through wherein the user's arms follow the swing arm upward after striking the ball and the user's arm continues to follow the swing arm and body rotation to the left.

FIGS. 4-7 show a progression of motion in a normal golf swing. FIG. 4 shows the user addressing the ball. FIG. 5 shows the golfer just after the downswing has begun. At this point, the waist and hips should already have started twisting to the left. FIG. 6 shows that with the waist and hips twisted to the left, the left arm comes in behind and pushes swing arm 4 to the left. FIG. 7 shows that after the ball has been hit, the user's arms continue to push swing arm 4 all the way to the left.

Figure 8:
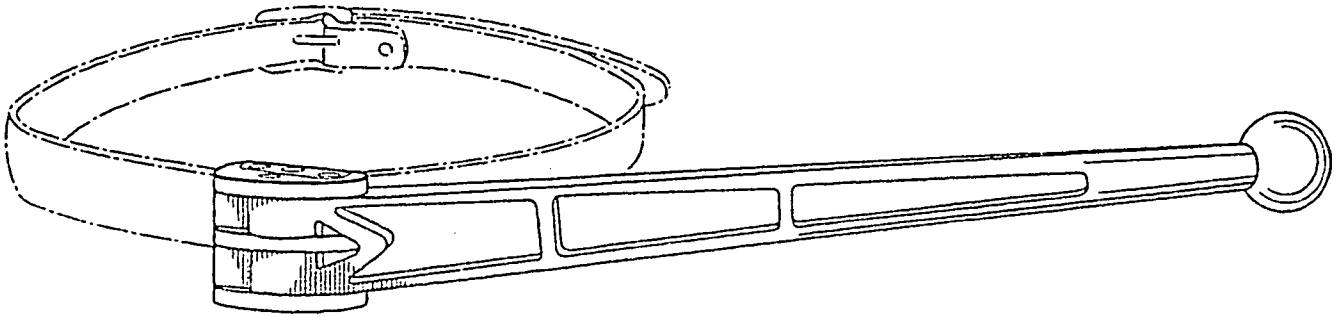
FIG. 8 shows a perspective front view of the golf swing trainer and the belt.
Figure 9:
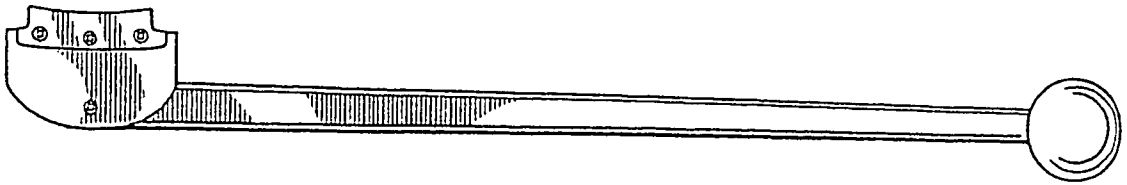
FIG. 9 shows a top view of the golf swing trainer arm.
Figure 10:
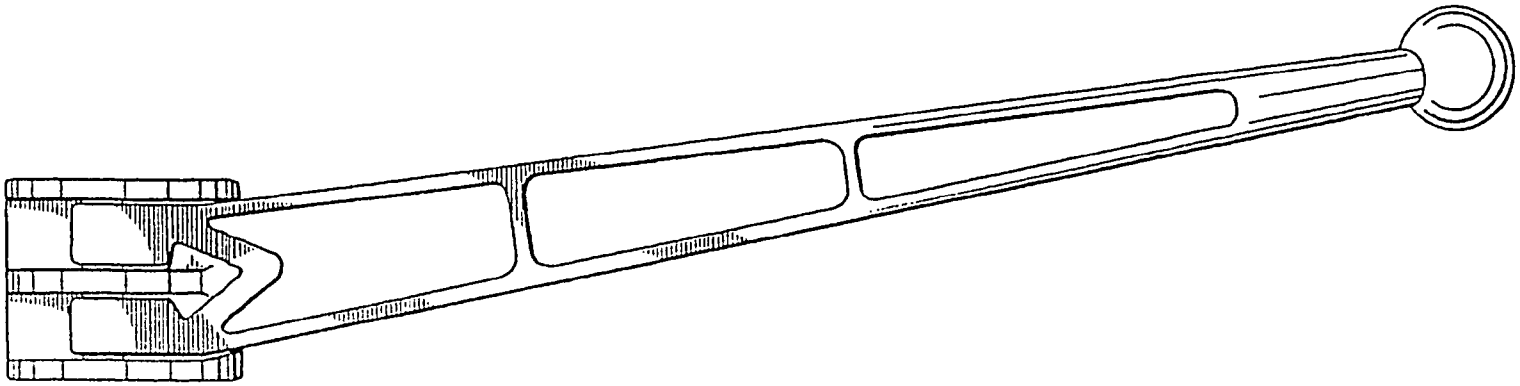
FIG. 10 shows a front view of the golf swing trainer arm.
Figure 11:
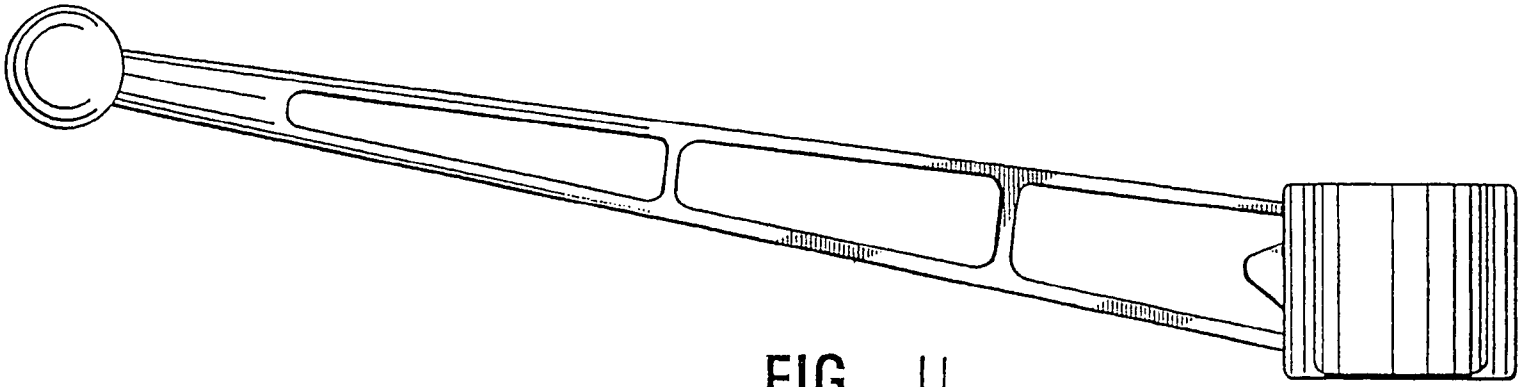
FIG. 11 shows a rear view of the golf swing trainer arm.
Figure 12:
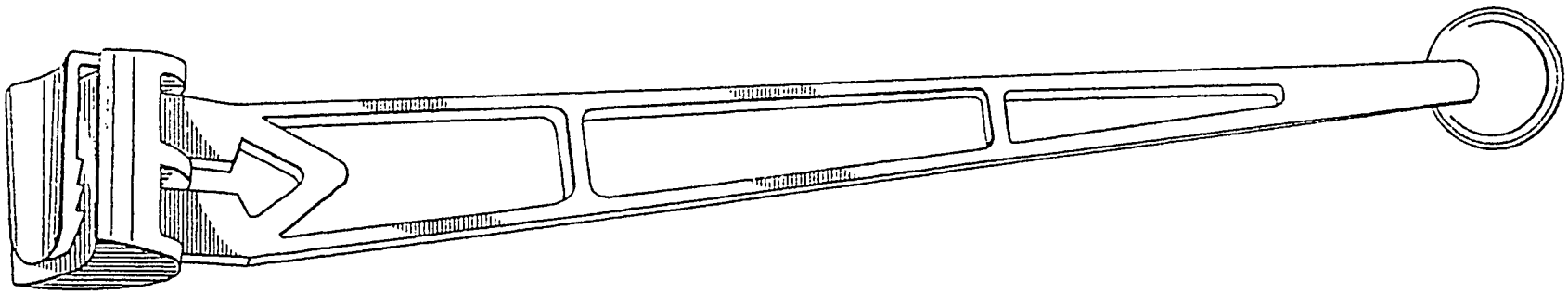
FIG. 12 shows a side view of the golf swing trainer arm.
Figure 13:
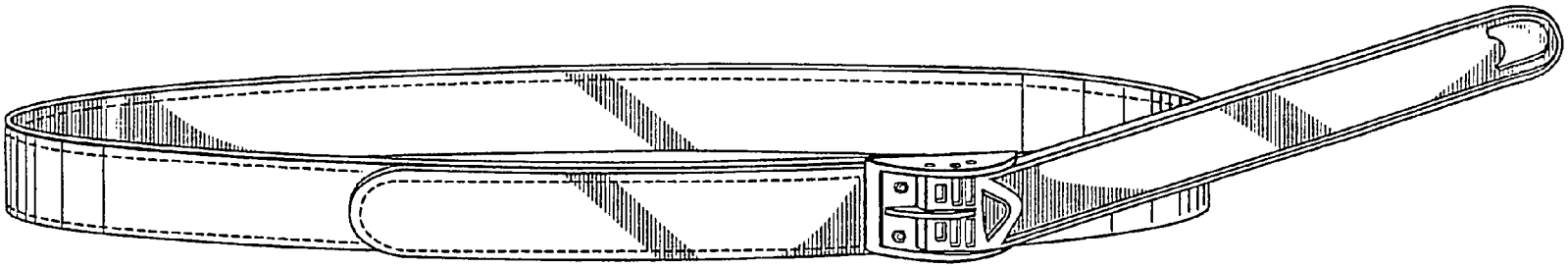
FIG. 13 shows a perspective front view of an alternate embodiment of the golf swing trainer and the belt.
Figure 14:
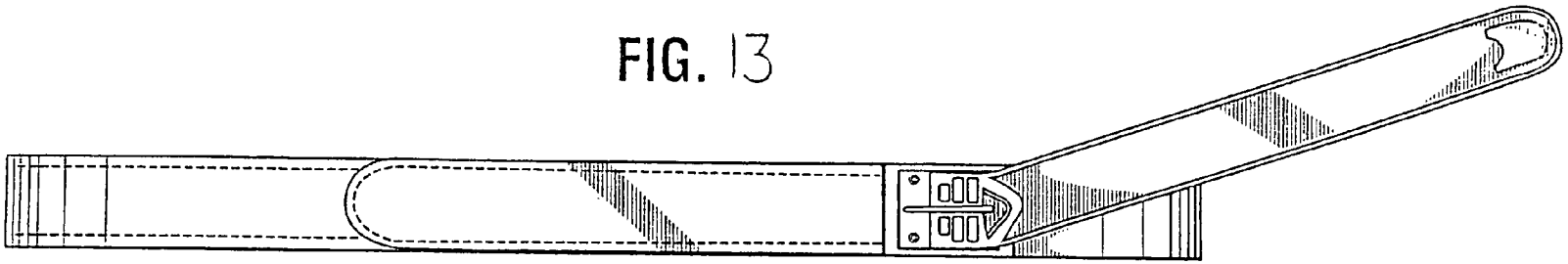
FIG. 14 shows a front view of the golf swing trainer arm of the embodiment of FIG. 13.
Figure 15:
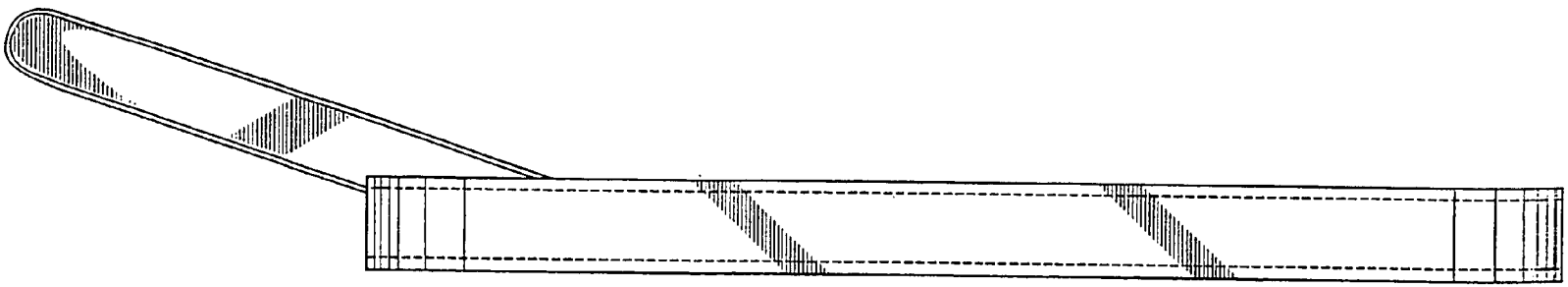
FIG. 15 shows a rear view of the golf swing trainer arm and belt of the embodiment of FIG. 13.

FIG. 8 shows the result of incorrect club and hip movement timing. When the waist didn't twist to the left soon enough, the user's arms come down in front of swing arm 4 and therefore, don't carry it on around to the left. Upon seeing that the swing arm didn't move, the user get's immediate feedback and knows that the waist moved too late during the swing.

Figure 3:
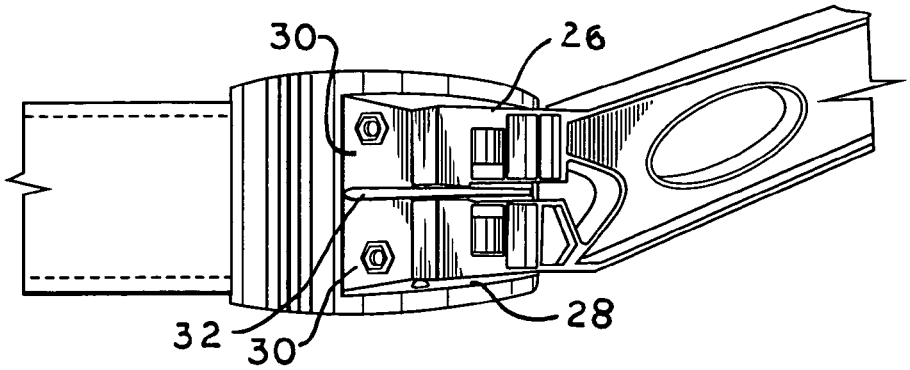
FIG. 3 is an oblique rear view of the base of an alternate embodiment of FIG. 1 showing attachment of the swing arm and base to a belt by a clip.

An alternate embodiment shown in FIG. 3 is provided without a permanently attached belt. Base member 2 is attached to the user's belt using clip 8 as shown in FIG. 3 rather than screws. Using this approach, the trainer may be attached directly to the belt which the user may be wearing rather than requiring the user to put on a belt which is permanently attached to a trainer.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A golf swing trainer comprising:

a base member rigidly secured to a belt member sized to be securely fastened around a user's waist, said base member having a pivot pin and a swing arm, said swing arm pivotally mounting to said base member by said pivot pin and being capable of swinging horizontally in an arc of approximately 180 degrees, wherein said swing arm is canted up at an angle between 1 and 20 degrees from a plane which is perpendicular to said pivot pin.

2. The golf swing trainer of claim 1 wherein said swing arm is canted up at an angle between 10 and 15 degrees from a plane which is perpendicular to said pivot pin.

3. The golf swing trainer of claim 1 wherein said pivot pin is a screw which can be tightened or loosened to adjust the amount of force which is required to swing said swing arm.

4. A golf swing trainer comprising a base member rigidly secured to a belt member sized to be securely fastened around a user's waist, said base member having a pivot pin and a swing arm, said swing arm pivotally mounting to said base member by said pivot pin and being capable of swinging horizontally in an arc wherein said swing arm is canted up at an angle from a plane which is perpendicular to said pivot pin.

5. The golf swing trainer of claim 4, wherein said angle is from between 1 and 20 degrees.

6. The golf swing trainer of claim 4 wherein said pivot pin is a screw which can be tightened or loosened to adjust the amount of force which is required to swing said swing arm.

7. The golf swing trainer of claim 4, wherein said arc comprises approximately 180 degrees.

8. The golf swing trainer of claim 4, said base member further including at least one break-away positioning means in cooperative relationship with said swing arm pivotally mounting to said base member.

9. The golf swing trainer of claim 8, wherein said break-away positioning means comprises a least one channel including a top surface and a bottom surface extending horizontally along a front surface of said base plate and a compressible projection means projecting from at least one of said top surface and said bottom surface cooperatively engaging a detent formed in at least one of a top or bottom edge at proximate end of said swing arm.

10. The golf swing trainer of claim 8, wherein said break-away positioning means comprises a least one channel including a top surface and a bottom surface extending horizontally along a front surface of said base plate with a detent formed therein for cooperatively engaging a compressible projection means projecting from at least one of a top edge and a bottom edge of a proximate end of said swing arm.

11. A golf swing trainer comprising a base member rigidly secured to a belt member sized to be securely fastened around a user's waist, said base member having a pivot pin and a swing arm, said swing arm pivotally mounting to said base member by said pivot pin and being capable of swinging horizontally in an arc wherein said swing arm is canted up at an angle from a plane which is perpendicular to said pivot pin, and said base member further including at least one break-away positioning means in cooperative relationship with said swing arm pivotally mounting to said base member.

12. The golf swing trainer of claim 11, wherein said break-away positioning means comprises a least one channel including a top surface and a bottom surface extending horizontally along a front surface of said base plate and a compressible projection means projecting from at least one of said top surface and said bottom surface cooperatively engaging a detent formed in at least one of a top or bottom edge at proximate end of said swing arm.

13. The golf swing trainer of claim 11, wherein said break-away positioning means comprises a least one channel including a top surface and a bottom surface extending horizontally along a front surface of said base plate with a detent formed therein for cooperatively engaging a compressible projection means projecting from at least one of a top edge and a bottom edge of a proximate end of said swing arm.

14. The golf swing trainer of claim 11, wherein said angle is from between 1 and 20 degrees.

15. The golf swing trainer of claim 11 wherein said pivot pin is a screw which can be tightened or loosened to adjust the amount of force which is required to swing said swing arm.

16. The golf swing trainer of claim 11, wherein said arc comprises approximately 180 degrees.

17. The golf swing trainer of claim 11, including a horizontal guide flange medially disposed within said channel for cooperative sliding engagement with a horizontal slot formed in the distal end of said swing arm.

* * * * *